United States Patent [19]

Heuwieser et al.

[11] 4,173,963

[45] Nov. 13, 1979

[54] ELECTRONIC MAGNETO IGNITION FOR INTERNAL COMBUSTION ENGINES

[75] Inventors: Erwin Heuwieser, Haar; Cosimo Scianna; Klaus Wetzel, both of Munich, all of Fed. Rep. of Germany

[73] Assignee: Siemens Aktiengesellschaft, Berlin & Munich, Fed. Rep. of Germany

[21] Appl. No.: 800,742

[22] Filed: May 26, 1977

[30] Foreign Application Priority Data

Jul. 6, 1976 [DE] Fed. Rep. of Germany ..... 2630372

[51] Int. Cl.[2] ..... F02P 1/02; H05B 41/36

[52] U.S. Cl. ..... 123/149 D; 123/148 E; 315/209 T; 315/209 SC; 315/218

[58] Field of Search ..... 123/148 E, 149 D, 149 A, 123/149 B, 149 C, 148 CC; 315/209 T, 209 SC, 218

[56] References Cited

U.S. PATENT DOCUMENTS

| | | | |
|---|---|---|---|
| 3,169,212 | 2/1965 | Walters | 315/209 T |
| 3,484,677 | 12/1969 | Piteo | 123/148 E |
| 3,490,426 | 1/1970 | Farr | 123/149 D |
| 3,612,023 | 10/1971 | Sohner et al. | 123/148 CC |
| 3,630,185 | 12/1971 | Struber et al. | 123/149 D |
| 3,938,491 | 2/1976 | Mazz | 315/209 T |
| 3,958,546 | 5/1976 | Ohki et al. | 123/148 E |
| 3,963,015 | 6/1976 | Haubner et al. | 123/148 E |

FOREIGN PATENT DOCUMENTS

| | | | |
|---|---|---|---|
| 1809283 | 7/1969 | Fed. Rep. of Germany | 123/148 CC |
| 698733 | 11/1965 | Italy | 123/148 CC |

*Primary Examiner*—Charles J. Myhre
*Assistant Examiner*—P. S. Lall
*Attorney, Agent, or Firm*—Hill, Van Santen, Steadman, Chiara & Simpson

[57] ABSTRACT

An electronic magneto ignition for internal combustion engines has a permanent magnet mounted on the engine fly wheel and rotating therewith. A magnetic field coil has a primary winding and a secondary winding in which ignition current and ignition voltage, respectively, are produced during the passage of the permanent magnet. A switching transistor is connected in parallel with the primary winding and in parallel with a diode poled opposite to the emitter-collector path of the transistor. An electronic control circuit blocks the switching transistor at the desired ignition time so that the primary circuit is interrupted and the high voltage for the combustion of the fuel is produced in the secondary winding. In the electronic control circuit, a parallel circuit consisting of a first control coil, which has a resistor in series therewith, and a thyristor is connected from the base to the emitter of the switching transistor. Another resistor is connected from the collector of the switching transistor, as a feedback resistor, to the control electrode of the thyristor. A second control coil has a potentiometer connected in parallel, the potentiometer having a movable tap so that a portion of the voltage applied to the resistor is fed to the control electrode of the thyristor. The first control coil is arranged at an angle from the ignition coil and the second control coil is arranged at an angle from the first control coil, as viewed in the direction of rotation of the fly wheel.

9 Claims, 4 Drawing Figures

ELECTRONIC MAGNETO IGNITION FOR INTERNAL COMBUSTION ENGINES

BACKGROUND OF THE INVENTION

1. Field of the Invention

The present invention relates to an electronic magneto ignition for internal combustion engines which have a permanent magnet mounted on the engine fly wheel and which have a magnetic field coil with a primary winding and a secondary winding in which ignition current and voltage, respectively, is produced during the passage of the permanent magnet, and more particularly to such an ignition in which a switching transistor is connected in parallel with the primary winding of the magnetic field coil, in which a diode is connected in parallel to the primary winding of the magnetic field coil, and in which an electronic circuit blocks the switching transistor at the desired ignition time so that the primary circuit is interrupted and the high voltage for ignition of the fuel mixture is produced in the secondary winding.

2. Description of the Prior Art

Magneto ignitions, in contrast to battery ignitions, are not fed by an accumulator. Instead, the required energy is produced in a coil which is generally identical with the ignition coil, by means of a permanent magnet moving past the coil. The electric values of the induced signals are dependent on the angle and the speed of rotation. The ignition must result from an irregular interruption of the ignition coil circuit.

The permanent magnet is mounted on the fly wheel of the engine. If the engine moves the permanent magnet past an ignition coil which is mounted on a U-shaped magnet core, and if the breaker points are closed, then a small negative current flows at first when the magnet enters the coil field. If both the magnetic poles are located in the magneto circuit of the coil, then the current flows in the positive direction. The greatest instantaneous current flows if the magnet is centrally located across the coil. If the breaker points are now opened with the aid of a cam, if possible during the greatest current flow, then a high voltage is formed in the coil by means of the sudden current interruption. This voltage can be stepped up with the aid of a secondary winding so that voltages up to 30 kV are formed which are conveyed to the spark plug to trigger the ignition spark for the combustion of the fuel mixture.

Magneto ignitions which have mechanical contacts, still widespread in use at the present time, have decisive disadvantages; they are, in particular, the heavy burning of the contacts, the spark advance produced by this burning whereby not only the engine output can be lowered but also the ignition time can be situated beyond the maximum current flow, and the contact openings and closings which make the use of mechanical contacts impossible at rotational speeds above 8000 rpm. For these reasons, electronic solutions are being increasingly employed, in spite of the higher costs involved.

A transistor is offered as an electronic switch having good cut-off properties, in contrast to the thyristor. However, the production of the base control current is a problem in the use of a transistor. A conventional solution utilizes a switching transistor in parallel with the primary winding of the ignition coil.

A control transistor is connected in parallel to the base-emitter path of the switching transistor and a Zener diode is connected to the base of the control transistor. If the coil is excited, the control transistor is presently blocked and the switching transistor becomes conductive by way of a base resistor. The primary current therefore flows by way of the switching transistor wherein, however, the residual voltage drop remaining in the switching transistor cannot be neglected. This type of known circuit is dimensioned in such a manner that the transistor residual voltage increases close to the current maximum, so that the control transistor receives control current by way of the Zener diode and becomes conductive. At this moment, the switching transistor is blocked, and the primary circuit of the ignition coil is interrupted, whereby the ignition voltage is formed. The disadvantage of this known type of circuit resides in the fact that in the primary circuit a high residual voltage must remain in the transistors and base resistances, in order to produce the control current, and in that an ignition time adjustment dependent upon the rotational speed is not possible.

SUMMARY OF THE INVENTION

The primary object of the present invention is to provide an improved electronic circuit for an electronic magneto ignition wherein the residual voltages are decreased in the primary circuit, the ignition voltage and the ignition energy is increased, and a defined ignition time adjustment dependent on the rotational speed is possible.

The above object is achieved, according to the invention, in that a parallel circuit comprising a thyristor and a first control coil, having a series resistor, the parallel circuit being connected from the base to the emitter of the switching transistor, and another resistor is connected from the collector of the switching transistor, as a feedback resistor, to the control electrode of the thyristor. A second control coil is provided with a parallel connected resistor, the resistor being variable with a movable tap, such that a portion of the voltage applied to the resistor is fed to the control electrode of the thyristor. As viewed in the direction of rotation of the fly wheel, the first control coil is arranged at an angle behind the magneto ignition coil, and the second control coil is arranged at an angle behind the first control coil.

BRIEF DESCRIPTION OF THE DRAWINGS

Other objects, features and advantages of the invention, its organization, construction and operation will be best understood from the following detailed description taken in conjunction with the accompanying drawings, on which.

DESCRIPTION OF THE PREFERRED EMBODIMENT

Figure 1:
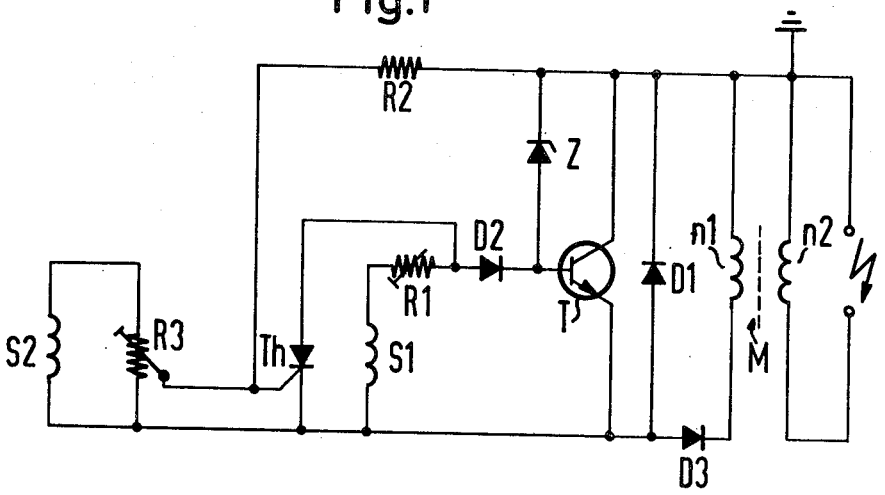
FIG. 1 is a schematic circuit diagram of an electronic magneto ignition constructed in accordance with the principles of the present invention.

Referring to FIG. 1, an advantageous embodiment of the invention is illustrated in which one will readily recognize a magneto ignition coil M having a primary winding n1 and a secondary winding n2. A switching transistor T is connected in parallel with the primary winding n1, as is a diode D1, the diode and the transistor being oppositely poled. A circuit comprising a thyristor Th and a first control coil S1, with a series resistor R1, is connected in parallel with the base-emitter circuit of the switching transistor T. A resistor R2 is connected between the collector of the transistor T and the control electrode of the thyristor Th.

The circuit just described already forms a complete electronic ignition circuit. As soon as the permanent magnet is located across the magneto ignition coil M, a voltage is produced in the control coil S1 by means of the scattering field of the permanent magnet, this voltage permitting the residual voltage of the switching transistor T to increase at the desired ignition time of the control coil S1 is correctly poled. This slight increase of the residual voltage effects the ignition of the thyristor Th by way of the resistor R2, whereby the switching transistor T is immediately blocked. It is thereby provided that an ignition is triggered in any case by way of the feedback resistor R2. The ignition time per se can be varied by means of adjusting the resistor R1.

A second control coil S2 serves for adjusting the ignition time as a function of the rotational speed of the engine, the control coil S2 having an adjustable resistor R3 connected in parallel therewith, and the resistor R3 having a movable tape connected to apply a portion of the voltage across the resistor to the control electrode of the thyristor Th. This voltage increase with increasing rotational speed of the engine fly wheel so that, with increasing rotational speed, the switching voltage of the thyristor is chronologically obtained earlier in the desired manner. The second control coil S2 lies in the scattering field of the permanent magnet, and removed at such a distance from the ignition coil that during the time in which the primary current of the ignition coil M passes its maximum, the voltage in the control coil S2 increases continuously.

A Zener diode Z is connected in parallel to the base-collector circuit of the switching transistor T, which together with a diode D2 connected in series with the base protects the switching transistor T from voltage peaks.

The diode D3 is connected in the primary circuit of the ignition coil M. The diode D3 is poled in such a manner that the negative half waves of the primary current as suppressed. Moreover, the diode D3 increases the primary peak current in the positive half wave due to the altered switch-on behavior.

Figure 2:
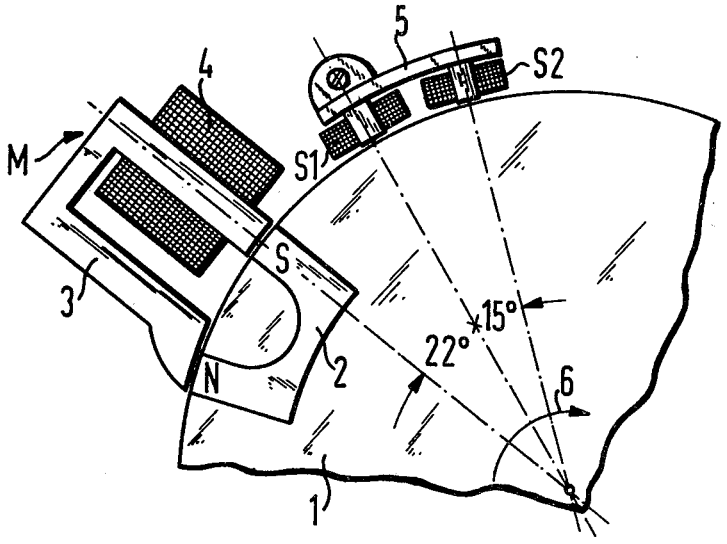
FIG. 2 is an elevational view of a fly wheel and the association therewith of the permanent magnet, the magneto ignition coil, the first control coil and the second control coil of the present invention.

FIG. 2 illustrates the mechanical arrangement of the magneto ignition coil M, the first and second control coils S1, S2 and the engine fly wheel 1. A horseshoe-shaped permanent magnet 2 is carried in the fly wheel 1 and has a north pole N and a south pole S. The direction of rotation of the fly wheel 1 is indicated by the arrow 6. The magneto ignition coil M is located at the periphery of the fly wheel 1, the ignition coil M comprising a U-shaped magnet core 3 and a coil 4 which contains the primary and secondary windings n1 and n2. In the direction of rotation of the fly wheel 1, the first control coil S1 is situated behind the magneto ignition coil M, and the second control coil S2 is mounted on a common ferromagnetic yoke 5 with the control coil S1 and at a further distance from the magneto ignition coil M. By means of the yoke 5, it is provided that the control coil S2 is situated for a very long time in the scattering field of the permanent magnet 2. The angle between the magneto ignition coil M and the control S1 advantageously amounts to 22°, and the angle between the control coil S1 and the control coil S2 advantageously amounts to 15°. However, these angles are, to a certain extent, dependent upon the data of the internal combustion engine and the magnet.

Figure 3:
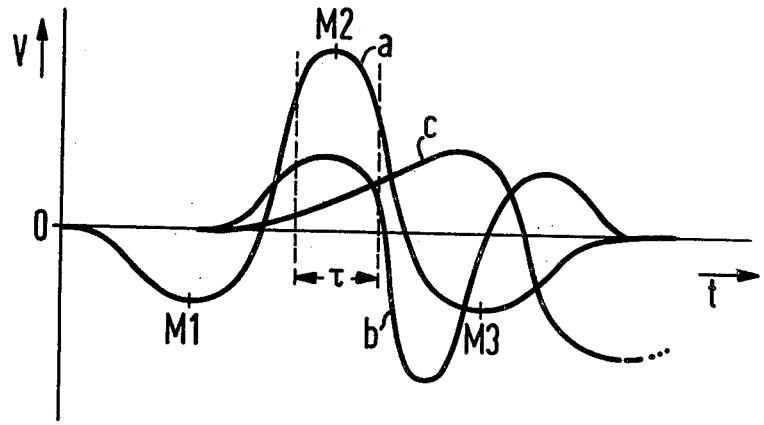
FIG. 3 is a graphic illustration of wave forms which apply to the circuit of FIG. 1.

Referring to FIG. 3, the idling voltages produced in the individual coils are plotted in an orthogonal system with the voltage V on the ordinate and the time t on the abscissa. A curve a illustrates the voltage of the primary winding n1 of the magneto ignition coil M. It is apparent that the voltage, starting at zero, first attains a negative maximum M1 as soon as the south pole of the permanent magnet has reached the left core side. The voltage subsequently increases to a high positive maximum M2, as soon as the permanent magnet is centrally located over the magnet core of the ignition coil. The voltage subsequently drops again, and reaches an additional negative maximum M3 as soon as the north pole has reached the right core side of the magneto ignition coil M. The curve b corresponds to the voltage produced in the first control coil S1. This voltage reaches its first maximum about simultaneously with the positive maximum M2 of the magneto ignition coil. The curve c represents the voltage produced in the second control coil S2. As mentioned above, the second control coil S2 is arranged in such a manner that the voltage produced therein increases as linearly as possible as long as the voltage in the magneto ignition coil passes its positive half wave. The ignition time adjustment possible is referenced with the time range $\tau$.

Figure 4:
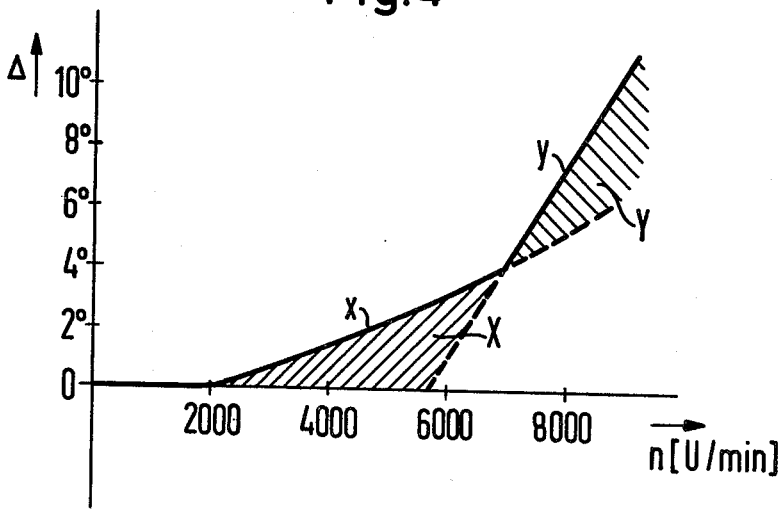
FIG. 4 is a graphic illustration showing the possible adjustment ranges of the ignition angle attainable for the circuit of FIG. 1.

Referring to FIG. 4, the ignition adjustment angle $\Delta$ attainable with the aid of the circuit of FIG. 1, in dependence on the rotational speed n, is illustrated. In FIG. 4 the curve section x and the shaded area section X delimited thereby with the aid of the resistor R1, and the curve section y and the shaded area section Y delimited thereby with the aid of the resistor R3 represents the adjustment range of the characteristic curve.

Although we have described our invention by reference to a particular illustrative embodiment thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. An electronic magneto ignition for an internal combustion engine which has a rotating fly wheel with a permanent magnet mounted thereon, comprising:

a magnetic ignition coil mounted adjacent the fly wheel and including a primary winding and a secondary winding for producing an ignition voltage, in response to rotation of the permanent magnet therepast;

a switching transistor including a base, an emitter and a collector, the emitter-collector circuit connected across said primary winding;

a first diode connected in parallel to said primary winding and poled opposite the emitter-collector circuit of said transistor; and an electronic control circuit for blocking said switching transistor at a desired ignition time to interrupt the circuit of said primary winding and cause a high ignition voltage in said secondary winding for igniting the fuel mixture of the internal combustion engine, said control circuit comprising a first control coil mounted adjacent the fly wheel spaced at a first angle from said ignition coil in the direction of rotation of the fly wheel, a first resistor connected in series with said first control coil, said first resistor and said first control coil series combination connected across the base-emitter circuit of said transistor, a thyristor including a control electrode, and a controlled conduction path connected in parallel with the first resistor-first control coil combination, a second resistor connected as a feedback resistor between said collector and said control electrode, a second control coil mounted adjacent the fly wheel, a third resistor connected in parallel with said second control coil, said third resistor including a tap connected to said control electrode for applying a portion of the voltage induced in said second control coil to said control electrode, a Zener second diode connected between said base and said collector of said transistor, and a third diode connected between said first control coil-first resistor combination and said base of said first resistor.

2. The ignition of claim 1, wherein:

said first control coil is mounted at an angle of about 22° from said magnetic ignition coil.

3. The ignition of claim 1, wherein:

said second control coil is mounted at an angle of about 15° from said first control coil.

4. The ignition of claim 1, wherein:

said first control coil is mounted at an angle of about 22° from said ignition coil; and said second control coil is mounted at an angle of about 15° from said first control coil.

5. The ignition of claim 1, comprising:

a yoke of ferromagnetic material mounting said first and second control coils.

6. The ignition of claim 1, wherein:

said first and third resistors are variable resistors.

7. The ignition of claim 1, comprising:

fourth diode connected in series with said primary winding to prevent current flow during negative half cycles of the primary voltage induced by the permanent magnet.

8. The ignition of claim 1, comprising:

an integrated circuit including said switching transistor and said first diode.

9. An electronic magneto ignition for an internal combustion engine which has a rotating fly wheel with a permanent magnet mounted thereon, comprising:

an ignition coil mounted adjacent said fly wheel and including a primary winding and a secondary winding;

a switching transistor including a base, an emitter and a collector with the emitter-collector circuit connected across said primary winding;

a first diode connected across said primary winding and poled opposite to the emitter-collector circuit of said transistor; and an electronic circuit for blocking said transistor at a desired ignition time to interrupt the circuit of said primary winding and cause a high ignition voltage in said secondary winding for igniting the full mixture of the internal combustion engine, said control circuit comprising a ferromagnetic yoke, first and second control coils mounted on said yoke at about 22° and 37°, respectively, from said ignition coil in the direction of rotation of the fly wheel, an adjustable first resistor connected in series with said first control coil, a second diode connecting said first resistor to said base of said transistor, a thyristor including a control electrode, and a controlled conduction path connected across the first resistor-first control coil series combination and to said base via said second diode, a Zener third diode connected between said base and said collector of said transistor, a feedback second resistor connected between said collector and said control electrode, an adjustable third resistor connected across said second control coil, including a tap connected to said control electrode for applying thereto a portion of the voltage induced into said second control coil, and a fourth diode connected in series with said primary winding for preventing current flow through said primary winding during one of the half cycles of the primary voltage induced by the permanent magnet.

* * * * *